US009827775B2

(12) United States Patent
Arimura

(10) Patent No.: US 9,827,775 B2
(45) Date of Patent: Nov. 28, 2017

(54) INK CARTRIDGE

(71) Applicant: RISO KAGAKU CORPORATION, Tokyo (JP)

(72) Inventor: Eijiro Arimura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/423,866

(22) Filed: Feb. 3, 2017

(65) Prior Publication Data

US 2017/0225474 A1 Aug. 10, 2017

(30) Foreign Application Priority Data

Feb. 10, 2016 (JP) ..... 2016-023807

(51) Int. Cl.
*B41J 2/175* (2006.01)
*B65D 77/20* (2006.01)
*B65D 77/30* (2006.01)

(52) U.S. Cl.
CPC ..... *B41J 2/17533* (2013.01); *B41J 2/1754* (2013.01); *B41J 2/17503* (2013.01); *B41J 2/17553* (2013.01); *B65D 77/2028* (2013.01); *B65D 77/2032* (2013.01); *B65D 77/30* (2013.01); *B41J 2002/17516* (2013.01)

(58) Field of Classification Search
CPC .. B41J 2/17533; B41J 2/17553; B41J 2/1754; B41J 2/17503; B41J 2002/17516; B65D 77/2032; B65D 77/2028; B65D 77/30
See application file for complete search history.

(56) References Cited

U.S. PATENT DOCUMENTS 5,690,230 A * 11/1997 Griffith ..... B65D 5/725 206/494
6,286,946 B1 9/2001 Umemura et al.
2003/0174192 A1* 9/2003 Nanjo ..... B41J 2/1754 347/86
2005/0099471 A1 5/2005 Mukai et al.
2010/0085404 A1 4/2010 Akiyama

FOREIGN PATENT DOCUMENTS

JP 2010-82994 4/2010

OTHER PUBLICATIONS

Extended European Search Report for EP 17155597.2, dated Aug. 31, 2017.

* cited by examiner

*Primary Examiner* — Geoffrey Mruk
(74) *Attorney, Agent, or Firm* — Greenblum & Bernstein, P.L.C.

(57) ABSTRACT

An ink cartridge contains an outer package, an ink container within the outer package, and sheet bodies attached to an outer surface of the outer package, and is attachable to and detachable from a printing device. Small pieces are formed by cuts in the outer package. The small pieces include breakable sections, and the bendable sections. Sheet bodies cover a portion of the small pieces. Pressing on a small piece with a finger breaks the breakable section, and bends the bendable section to press them inside the outer package. A portion of the sheet body then shifts upwards so that the sheet body can be grasped with fingers and peeled away from the outer package. Disassembly and sorting of used cartridges in this way becomes easier.

6 Claims, 6 Drawing Sheets

INK CARTRIDGE

TECHNICAL FIELD

The present invention relates to an ink cartridge attachable to and detachable from an inkjet printing device for dispensing ink onto a print medium such as paper and forming images, and relates in particular to an ink cartridge capable of easily peeling a sheet body attached to the outer box of the ink cartridge to allow easy sorting.

BACKGROUND OF ART

The ink cartridge of the related art that prints a desired image onto paper serving as the print medium (object for printing) utilizes an ink cartridge for an inkjet recording device (hereafter, simply "ink cartridge") that supplies ink into the ink head. This ink cartridge has a structure that contains an ink container including an ink extracting section and an ink storage section in a box-shaped outer package.

The ink cartridge is preferably easy to attach to and detach from the inkjet printing device, durable against vibrations during shipping as well as the dropping that occurs during shipping and the handling process, and also capable of low-cost manufacture. To meet these needs, the applicants propose an ink cartridge such as disclosed in the following Patent document 1.

As shown in the drawing in FIG. 6, an ink cartridge 200 of the related art is a cuboid-shaped body attachable and detachable horizontally (direction for attaching/detaching operation) relative to the printing device, and contains an outer package 230 that is a long thin outer box made of cardboard, a mating surface 220 that is formed at the opening on one end of the outer package 230 and latches with the cartridge mounting mechanism of the printing device, and a fluid storage container housed in the outer package not shown in the drawing, that includes a dispensing port for dispensing ink in the mating surface 220.

Here, a mating surface 220 is mounted as previously described at the opening on one end of the long and thin outer package 230; and an adhesive sheet body 250 is attached across three surfaces; on the upper surface and an lower surface of the outer package 230, and a mating surface 220, that along with integrating the outer package 230 and mating surface 220 into one piece, also provides a sealed structure at one end of the outer package 230. The other end of the long and thin outer package 230 is also opened during assembly the same as the one end, but has a flap not shown in the drawing folded and assembled into the opening to form a box-shaped outer contour. As partially shown in the drawing, the other open end of the outer package 230 is also formed as a sealed structure by attaching one adhesive sheet body 260 across the three surfaces of the outer package; upper surface, other end side, and lower surface. The long and thin outer package 230 assembled open on both ends is in this way a structure that provides strength to the assembled sections and maintained in an overall box shape by covering both ends with the sheet bodies 250, 260.

Patent document 1: Japanese Unexamined Patent Application Publication No. 2010-82994

SUMMARY OF INVENTION

Technical Problem

As previously described, in the ink cartridge 200 of the related art disclosed in Patent document 1, the outer package

230 is made of paper such as cardboard; moreover the mating surface 220 exposed on one end of the outer package 230 and the fluid storage container not shown in the drawing and mounted on this mating surface 220 and housed within the outer package 230 are made of resin material. Moreover, the sheet bodies 250, 260 attached at both ends of the outer package 230 are normally made from material different from the material of the fluid storage container, etc. Here, in addition to the aim of maintaining the structural strength on both ends of the assembled outer package 230, the sheet bodies 250, 260 must also be printed with information relating to the product and usage precautions for the ink cartridge 200. Therefore, along with having sufficient strength to resist tearing, the sheet bodies must have satisfactory printability, and moreover must also be able to hold and be durable against the ink being used and therefore a sheet of such material employs film method synthetic paper with polypropylene as the main ingredient.

When the user has used up all the ink within the ink cartridge 200, that ink cartridge 200 must be appropriately disposed of. Namely, the ink cartridge 200 made from plural types of materials must be disassembled, sorted according to each designated material, and disposed of. However, the sheet bodies 250, 260 of film method synthetic paper attached to the cardboard outer package 230 are considerably strong and attached across the entire surface of the outer package 230 made of paper and are therefore extremely difficult to peel away, causing the problem that a great deal of effort is required from the user during disposal.

Whereupon, in view of the aforementioned problems, the present invention has the object of providing a sheet body that the user can peel away easily and that for example is film method synthetic paper attached to the outer package serving as the outer box of the ink cartridge.

According to a first aspect of the invention, an ink cartridge attachable to and detachable from a printing device that contains an outer package, an ink container that is housed inside the outer package, and a sheet body attached to an outer surface of the outer package, and in which the outer package contains:

a breakable section that is formed consecutively between a surface of the outer package covered by the sheet body and a surface of the outer package not covered by the sheet body and is broken by external force and, and a small piece that is subdivided by the breakable section and pressed inside the outer package by the breaking the breakable section.

According to a second aspect of the invention, in the ink cartridge described in a first aspect of the invention, other than the breakable sections, the small piece is subdivided from the outer package into bendable sections that are bent by external force; and the small piece is pressed to the inside of the outer package by the bending of the bendable sections along with breaking of the breakable section.

According to a third aspect of the invention, in the ink cartridge described in a first aspect of the invention, the breakable section contains intermittent cuts formed in a shape including a curve.

According to a fourth aspect of the invention, in the ink cartridge described in the first aspect through the third aspect on the invention, the outer package is a longitudinal box assembled from a single development piece, in which a first sheet body and a second sheet body having edge sides parallel with a width direction intersecting the longitudinal direction of the outer package respectively maintain a first edge section of an outer package formed with an ink outlet, and a second edge section of an outer package on the side opposite the first edge in their assembled state.

According to a fifth aspect of the invention, in the ink cartridge described in the fourth aspect of the invention, the first small piece is formed on the first edge section configured from the straight bendable section mounted along one long side parallel to the longitudinal direction, and the curved breakable section is formed to face the other long side from the bendable section.

According to a sixth aspect of the invention, in the ink cartridge described in the fourth or fifth aspect of the invention, the second small piece formed on the second edge section is configured from the straight bendable section mounted along the other short side opposite to one short side on the outlet side in parallel with the width direction, and the curved breakable section formed so as to face the one short side from the bendable section.

Advantageous Effects of Invention

After its ink has been consumed, the ink cartridge including the present invention appears promising for disassembly and disposal sorting by the user from the viewpoint of effective utilization of resources and environmental conservation. When performing disposal sorting, a sheet body of different material from the outer package made of paper must be peeled away from the outer package, the ink storage body removed and segregated from the outer package, and each item sorted by material.

Here, in the ink cartridge according to the first aspect of the invention, the small piece built into a portion of the outer package is placed so that the breakable section is consecutively placed relative to the outer package surface covered by the sheet body, and outer package surface not covered by the sheet body. Therefore, when the user presses the small piece of the outer package inward with a finger, the small piece breaks at the breakable section, sinks inwards in the outer package, and a portion of the sheet body peeled from the small piece is suspended upwards. If the user at this point pulls a portion of that sheet body upward with a finger, the sheet body can be cleanly peeled from the outer package in a simple procedure and operation.

In the ink cartridge according to the second aspect of the invention, when the user presses the small piece of the outer package with a finger, the breakable section breaks and separates from the outer package but the bendable section remains joined to the outer package and attains a bent state, and the small piece sinks inward in the outer package. The small piece is in a state joined to the outer package at the bendable section and so does not fully separate from the outer package, and is a joint piece with the outer package so can be discarded along with the outer package and so is comparatively easy to dispose of, compared to disassembly.

In the ink cartridge according to a third aspect of the invention, the breakable section is configured with intermittent cuts in a curving pattern so that when the user places a fingertip and presses the breakable section, a uniform force is applied to the overall breakable section along the bulge of the fingertip so that the task of reliably separating the small piece from the outer package by pressing inwards can be easily accomplished.

In the ink cartridge according to a fourth aspect of the invention, the longitudinal outer package which is the body of the ink cartridge, is assembled from a single development piece, and a first sheet body and a second sheet body are respectively attached on a first edge section where the ink outlet is mounted, and on a second edge section which is on the opposite side so that each edge section can be maintained in their assembled box-shape. Here, the first and second sheet bodies attached to the surface of the outer package contain edge sides parallel with the width direction intersecting the longitudinal direction of the outer package. The breakable sections of the small piece cross each other at the edge side of this sheet body and so pressing the small piece inward with a finger breaks the breakable section, to make the sheet body edge side suspend upwards, and the user can then grasp the edges of the sheet body, and with this as a start point the sheet body can be peeled along the longitudinal direction of the outer package.

In the ink cartridge according to a fifth aspect of the invention, a first small piece formed in close contact to the first edge where the ink outlet is mounted, has a straight bendable section placed along one of the long sides of the outer package in parallel with the longitudinal direction of the outer package, and the curved breakable section is formed so as to face the other long side along the width direction of the outer package from the bendable section. Therefore, when the user is performing the task of pressing the first small piece into the inside of the outer package, the user's finger pressing the first small piece grasps the longitudinal outer package from one of the long sides so there is no need to touch the edge where the ink outlet is located. Therefore, in the ink cartridge disassembly task after usage, users can peel the sheet body on the first edge side without staining their hands and also perform disassembly tasks. Also, the shape of the user's finger pressing the first small piece into the inside of the outer package matches the curve shape of the breakable section, and the bendable section is along the long side having especially high strength in the outer package so that the user's finger can in particular apply a highly effective force to the breakable section and the task of pressing the first small piece into the inside of the outer package is simple.

In the ink cartridge according to a sixth aspect of the invention, the second small piece formed in close contact to the second edge section on the side opposite the first edge section where the ink outlet is mounted, has a straight bendable section placed along the other short side of the second edge section of the outer package; and the curved breakable section is formed so as to face the other short side along the longitudinal direction of the outer package from the bendable section. Therefore, in the ink cartridge disassembly task after usage, when peeling the sheet body on the second edge side, the shape of the user's finger pressing the second small piece into the inside of the outer package matches the curve shape of the breakable section, and also the bendable section is along the short side having especially high strength in the outer package so that the user's finger can in particular apply a highly effective force to the breakable section, and the task of pressing the second small piece into the inside of the outer package is even simpler to perform.

DESCRIPTION OF EMBODIMENTS

The embodiments of the present invention are described next in detail while referring to the accompanying drawings. The present invention is not limited to the embodiments and the range of the present invention encompasses all adaptations, working examples, and technological applications, and so on that are capable of being conceived and rendered by one skilled in the art based on these embodiments.

In the specifications of the present invention, when utilizing terms for up, down, left, right for showing directions and positions in the following descriptions rendered while referring to the appended drawings, these terms match the up, down, left, right as viewed by the user as specified in each drawing.

Also, in the present invention, the direction for horizontally attaching/detaching an ink cartridge 1 to a printing device 100 is "attaching/detaching direction A"; the direction for inserting and loading the ink cartridge 1 into the printing device 100 is "loading direction A1"; and the direction for withdrawing and removing the ink cartridge 1 from the printing device 100 is "removing direction A2."

The loading direction A1 is the same direction that the ink filled in the ink cartridge 1 flows out to the printing device 100 (hereafter, "ink outflow direction B"); the insertion direction during storage of an ink container 10 in an outer package 20 is the same direction as the removing direction A2.

[1. Printing Device Overall Structure]

Figure 1A:
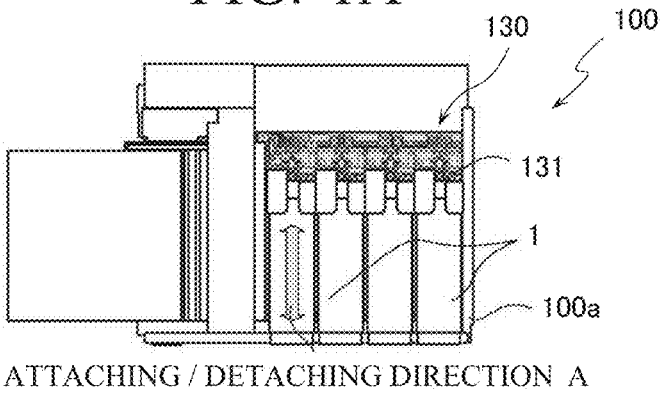
FIG. 1A is a schematic plan view showing the structure of the inkjet printing device for filling ink cartridges in the present invention.
Figure 1B:
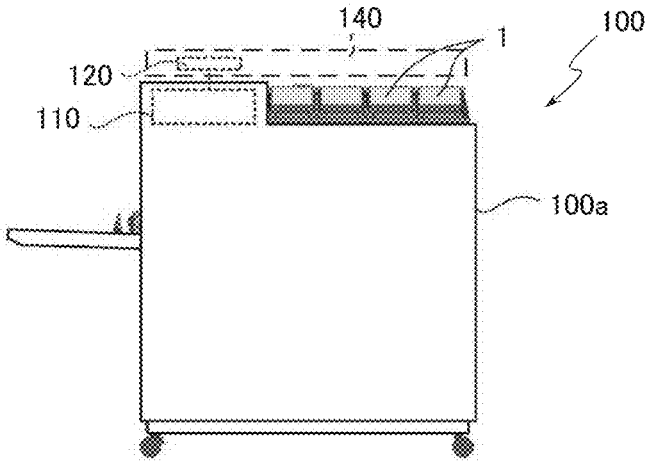
FIG. 1B is a schematic front view of the same device.
Figure 1C:
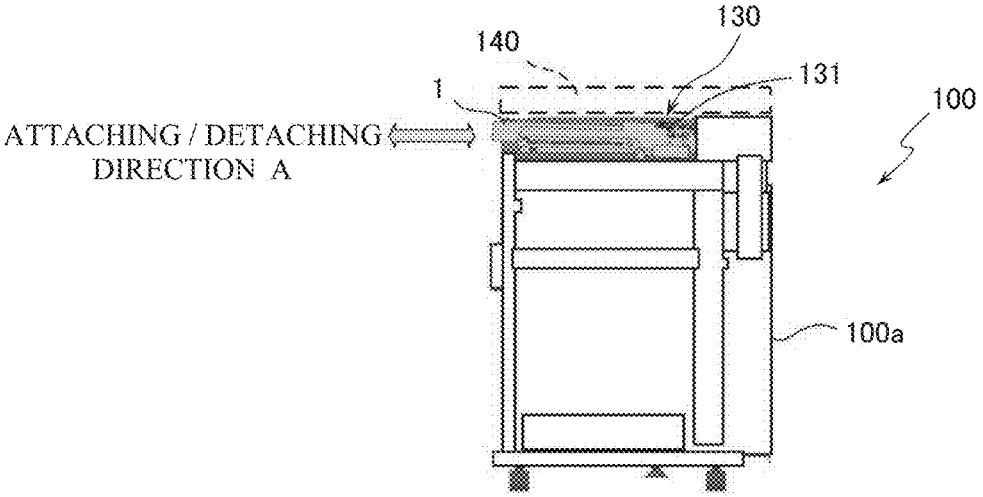
FIG. 1C is a schematic side view of the same device.

As shown in any of FIG. 1A through 1C, this description of the printing device 100 in which the ink cartridge 1 of the present embodiment is loaded, utilizes as an example, an inkjet type line color printer containing plural ink heads in which many nozzles are formed, printing is performed in line units dispensing ink of different colors from the respective heads, and plural images are formed so at to mutually overlap on the printing medium (paper) conveyed by conveyor belt to generate a full color image.

The present embodiment contains four ink head mounted in a line configuration, and forms images by dispensing four colors of black (K), cyan (C), magenta (M), and yellow (Y) from each of the ink heads. There are no particular restrictions on the number of ink heads and the type and number of colors of ink.

The printing device 100 contains a control unit 110 to execute the printing processing according to the printing job by controlling the overall operation of each unit that configures the device. In addition to the above-described printing processing by the ink heads and the drive control of the conveyor mechanism, the control unit 110 also controls the supply of ink from the ink cartridge 1.

Moreover, a setting operation unit 120 including for example entry devices such as operating keys and display/input panel is connected to the control unit 110, and the control unit 110 can receive instructions and setting operations by the user by way of the setting operation unit 120.

As shown in FIG. 1A and FIG. 1C, at the upper section of the device body 100*a* in the printing device 100, plural cartridge mounting mechanisms 130 for mounting the ink cartridges 1 are installed to each of the plural ink heads (a total of four to match the number of ink heads in the drawing).

An upper surface device 140 is mounted so as to cover the upper part of the cartridge mounting mechanism 130. During loading of the ink cartridge 1, the ink cartridge 1 is inserted horizontally (loading direction A1) between the lower surface of this upper surface device 140 and the upper surface of the body of the printing device 100. For example, the above-described setting operation unit 120 and an image reader device (scanner) for optically reading the documents set in and conveyed by the ADF (auto document feeder) are mounted in the upper surface device 140.

Moreover, a holder section 131 is mounted in the cartridge mounting mechanisms 130 to fit with the latching section 30 of the ink cartridge 1 described later during loading the ink cartridge 1 into the printing device 100.

[2. Ink Cartridge Overall Structure]

The structure of the ink cartridge 1 of the present invention is described next.

Figure 2A:
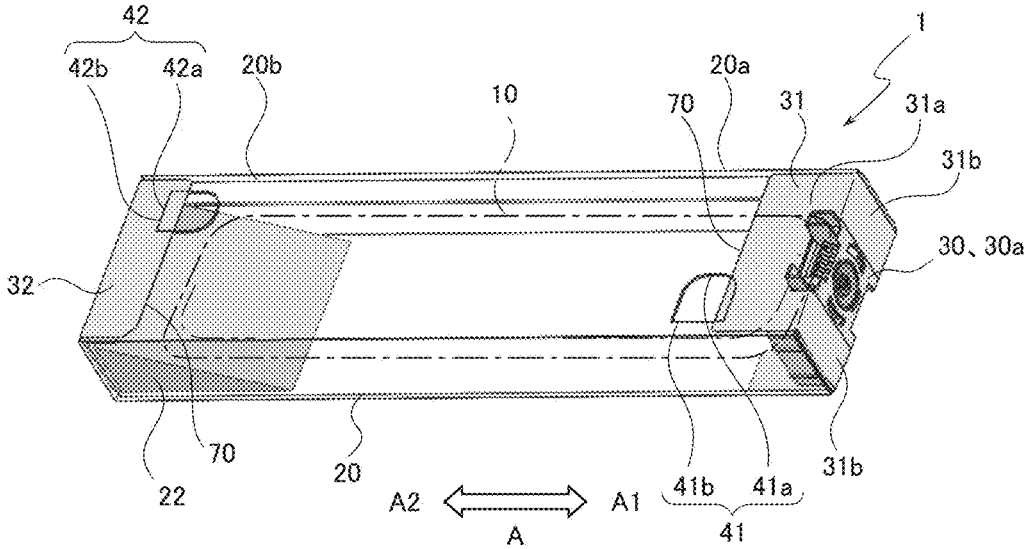
FIG. 2A is a schematic perspective view showing an outer view and the internal section as seen from the front side of the same ink cartridge.
Figure 2B:
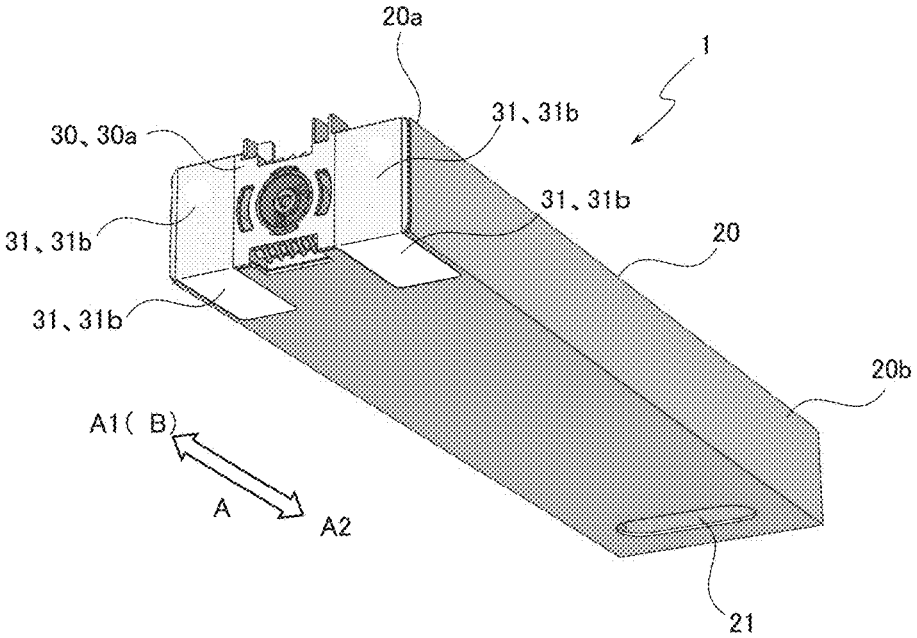
FIG. 2B is a schematic perspective view showing the external appearance of the same cartridge as seen from the rear side.

As shown in FIGS. 2A and 2B, the ink cartridge 1 is a roughly cuboid-shaped narrow body attachable and detachable along the attaching/detaching direction A which is a horizontal direction relative to the printing device 100. The ink cartridge 1 includes an ink container 10 which is a flexible ink storage body made from thermoplastic film material for filling the specified ink; an outer package 20 which is an outer box in which the ink container 10 is inserted; and a latching section 30 that is attached to one edge section 20*a* (first edge section) of outer package 20 and latches with the cartridge mounting mechanism 130 during filling into the printing device 100, along with being mounted on one end in the longitudinal direction of the ink container 10.

<2-1. Ink Container>

The ink container 10 shown by the chain line in FIG. 2A is a bag body in which the ink is sealed. Though not shown in detail in the drawings, the ink container 10 of the present embodiment is formed by overlapping two sheets of rectangular (cuboid-shaped) thermoplastic film 11 and in a state with a tube-shaped ink supply section (not shown in drawing) serving as the ink outlet on one end in the longitudinal direction interposed between the films 11 which are bonded on the periphery by heat (thermal) fusing. As described later on, the ink supply section serving as the ink outlet is assembled so as to pass through the panel-shaped latching section 30. The ink container 10 is inserted from the opening at one end section 20*a* of the outer package 20 described later on, and fits into the latch section 30 at the opening of one edge section 20*a* of the outer package 20 and thus configures the ink cartridge 1 of the present embodiment.

Though not shown in the drawing, the ink supply section serving as the ink outlet for the ink container 10 includes a tube connecting to the inside and outside of the ink container 10, an inside plug that is formed in this tube and releases or seals the connection, and a biasing unit to apply a force to the inside plug along the ink outflow direction B and seal the ink outlet. If the ink cartridge 1 is loaded in the printing device 100 at this time, when the latch section 30 in which the ink supply section is opened, is coupled to the cartridge mounting mechanism 130, the inside plug moves in a direction opposing the force of the biasing unit, the ink supply section is opened to connect the ink supply circuit of the printing device 100, and the ink within the ink container 10 of ink cartridge 1 can now be supplied to the printing device 100 along the ink outflow direction B.

<2-2. Latch Section>

As shown in FIGS. 2A and 2B, the latch section 30 is a roughly panel-like member formed from hard material such as resin or metal. An abutting surface 30*a* of the latch section 30 abutting the holder section 131 of printing device 100 faces the loading direction A1, and the latch section 30 functions as an attaching and detaching mechanism latching to the holder section 131 when the ink cartridge is loaded into the printing device. Moreover, the latch section 30 engages with the opening of one edge section 20*a* of the outer package 20 described later so that the size of the latch section is formed in approximately the same size as the dimension of the opening.

As shown in FIGS. 2A and 2B, in a state in which the latch section 30 engages with the opening of the outer package 20, the latch section 30 is clamped to the outer package 20 by a first sheet body 31 having adhesive on the back side. This sheet body 31 is configured from a base section 31*a* having width dimensions equivalent to the outer package 20, and two band sections 31*b* extending in parallel from the base section 31*a* at a specific distance. In a state in which the latch section 30 engages with the opening of the one edge section 20*a* of outer package 20, the base section 31*a* adheres to the entire upper surface near the one edge section 20*a* of outer package 20; and along with the two band sections 31*b* adhering to both sides of the abutting surface 30*a* which is the front side of latch section 30, the band sections 31*b* are further wound and adhered across the lower surface near the one edge section 20*a* of the outer package 20, and securely fasten the latch section 30 to the opening of the outer package 20 by way of the first sheet body 31.

<2-3. Outer Package>

Figure 3A:
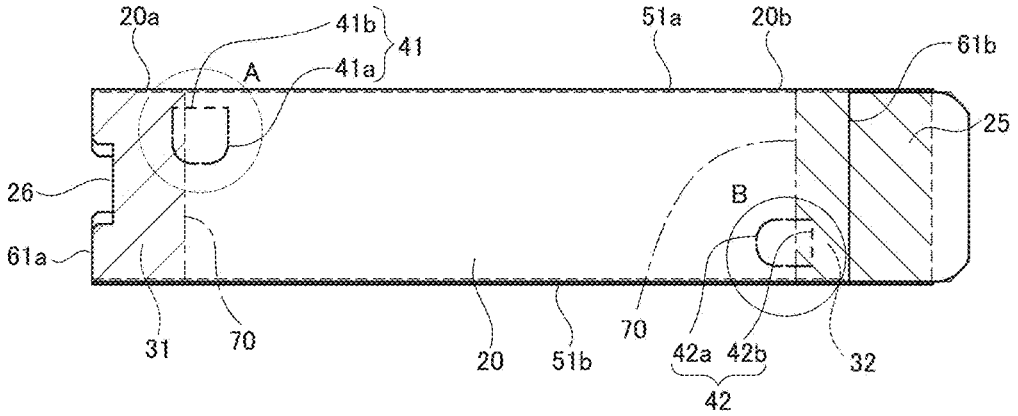
FIG. 3A is a plan view prior to assembly of the outer package for the same cartridge.
Figure 3B:
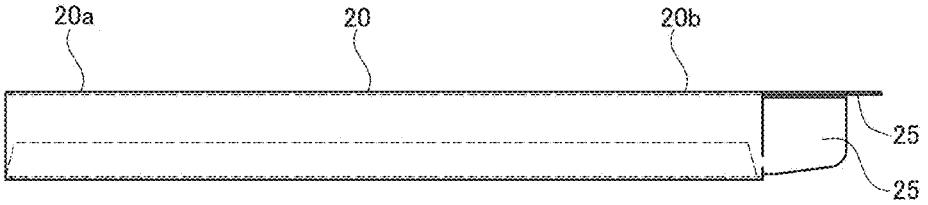
FIG. 3B is a frontal view prior to assembly of the outer package for the same cartridge.
Figure 3C:
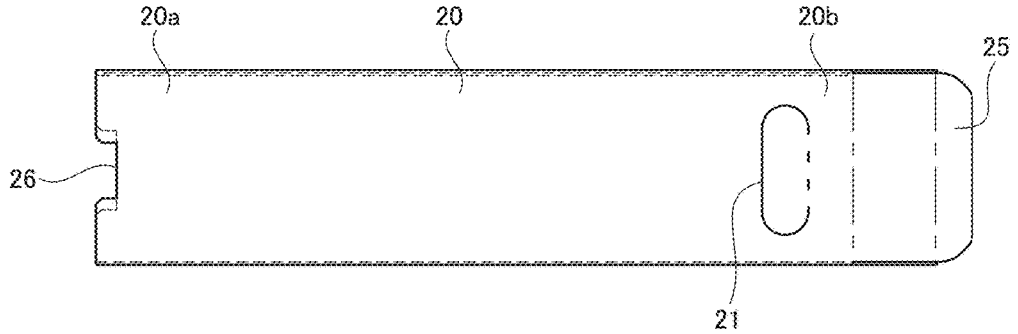
FIG. 3C is a bottom view prior to assembly of the outer package for the same cartridge.

As shown in FIGS. 3A to 3C, the outer package 20 is assembled into a box shape by bend forming a development sheet including fold lines, adhesive edge sides, and flap 25 formed in a sheet member of paper (for example, cardboard) and pasting the adhesive edge sides together; and the outer package 20 is tube box-shaped material forming hollow cuboid-shape and in which both of the one edge section 20*a* in the longitudinal direction (the first edge section where the latch section 30 is formed) and the other end section 20*b* (the second edge section on the side opposite the edge section where latch section 30 is formed) are opened. As described previously, an installation groove 26 is formed for the latch section 30 in the one edge section 20*a* so there is no flap 25, etc. However, a flap 25 is formed in the other edge section 20*b* and this flap 25 is folded and inserted into the inside section of the opening to seal the other edge section 20*b*.

In the present embodiment, when viewing the openings of one edge section 20*a* or the other edge section 20*b* as seen from left to right in FIGS. 3A to 3C, the ratio of the length of the horizontal sides parallel to the horizontal plane (length in up and down direction in FIGS. 3A and 3C), to the length of the vertical sides perpendicular to the horizontal plane (length in up and down direction in FIG. 33) is approximately 2 to 1 and forms a rectangular shape. As shown in FIGS. 3A and 3C, the ratio of the longitudinal dimensions of outer package 20 (left to right direction in the figure) to the dimensions in the short direction (up and down direction in the figure) are approximately 4 to 1 and form a rectangular shape.

A latch section 30 is fitted into the opening of the one edge section 20*a* of outer package 20 as already described, the first sheet body 31 adhesively bonds the one edge section 20*a* of outer package 20 to the latch section 30, and the one end section 20*a* of outer package 20 is securely fixed in the box-shaped structure. The outer package 20 prior to assembly is shown in FIG. 3A, and the first sheet body 31 attached to the one edge section 20*a* is shown virtually by way of oblique lines.

At the other edge section 20*b* as shown in FIGS. 2A and 2B, the flap 25 as shown in FIGS. 3A to 3C is bent inwards to assemble into a box shape, and further a second sheet body 32 is adhered to fasten the other edge section 20*b* of outer package 20. In other words, the second sheet body 32 is a sheet body having a width (dimension) equivalent to the outer package 20, and a length from the upper surface of the outer package 20 to the flap 25 serving as an edge (rear edge surface) of the other edge section 20*b*. The other edge section 20*b* of the outer package 20 is securely fastened into a box-shaped structure by adhering a portion of the sheet body 32 to the overall upper surface near the other edge section 20*b* of outer package 20, and winding and adhering across the edge section of other edge section 20*b* of outer package 20 clamped by the flap 25. The outer package 20 prior to assembly is shown in FIG. 3A, and the second sheet body 32 attached to the other edge section 20*b* is shown virtually by way of oblique lines.

In addition to the purpose of providing strength to the structure at both edge sections of the assembled outer package 20, the above-described first and second sheet bodies 31, 32 must also be printed with product information and usage precautions regarding the ink cartridge 1 and therefore along with having adequate strength against breakage, must also have good printability. Moreover, taking into account the possibility of ink leakage during attaching and detaching of the cartridge 1, the material quality must also preferably include resistance to ink within the ink container 10. A sheet body possessing these functions may for example utilize film method synthetic paper with polypropylene as the main ingredient.

A structure is formed in the outer package 20 of the ink cartridge to allow easily peeling and sorting of the first and second sheet bodies 31, 32 attached to the outer package 20.

In other words, as shown in FIGS. 2A, 2B, 3A, 3B, and 3C, the first and second small pieces 41, 42 serving as a cut for peeling the sheet body are respectively formed so as to partially overlap with the edges of the first and second sheet bodies 31, 32 at the upper surface of the outer package 20.

Figure 4A:
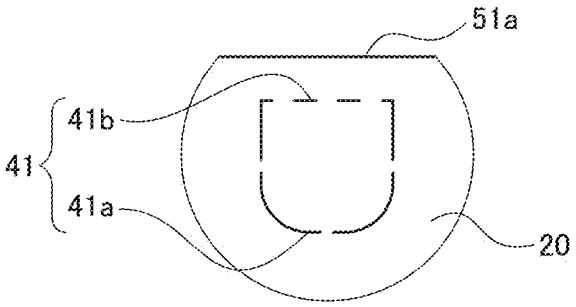
FIG. 4A is an enlarged plan view of the first small piece showing in the A section which is the fine line circle in FIG. 3A.
Figure 4B:
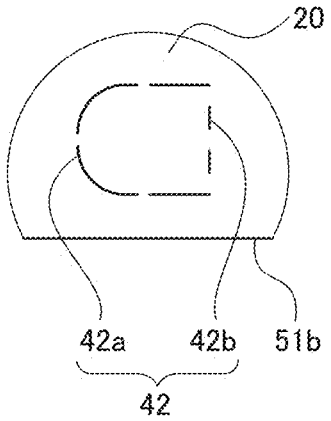
FIG. 4B is an enlarged plan view of the second small piece showing in the B section which is the fine line circle in FIG. 3A.

As shown in detail in the enlargement in FIGS. 4A and 4B along with the view shown in FIG. 3A, the first and second small pieces 41, 42 are formed into the upper surface of the outer package 20 as small areas subdivided by breakable sections 41*a*, 42*a* that break from external force, and bendable sections 41*b*, 42*b* that bend from external force, and by breaking the breakable sections 41*a*, 42*a* and bending the bendable sections 41*b*, 42*b*, the first and second small pieces 41, 42 can be pressed into the inside of the outer package 20.

The breakable sections 41*a*, 42*a* are formed in shapes including curves, and for example from intermittent cuts formed in roughly semi-circular shapes as shown in FIGS. 4A and 4B. The cuts of the breakable sections 41*a*, 42*a* may be a structure that does not easily break during normal usage but that do break when a suitable amount of force is applied, and may for example utilize tiny machine perforations.

The bendable sections 41*b*, 42*b* are sections connected to the outer package 20, and are straight sections having fewer intermittent cuts than the breakable sections 41*a*, 42*a* to ensure they are harder to break than the breakable sections 41*a*, 42*a* and easily bend when pressed. The bendable sections 41*b*, 42*b* should be able to stay joined to the outer package 20 without breaking when the breakable sections 41*a*, 42*a* have broken, and may also be simply formed as easily bendable tiny grooves.

The first and second small pieces 41, 42 as singly described next, are formed so that at least a portion of the breakable sections 41*a*, 42*a* are placed continuously between the surface of the outer package 20 covered by the sheet bodies 31, 32, and the surface of the outer package 20 not covered by the sheet bodies 31, 32.

As shown in FIG. 3A and FIG. 4A, in the first small piece 41 formed on the one edge section 20*a* of the outer package 20 the straight bendable section 41*b* is placed along one long side 51*a* in parallel with the longitudinal direction of the outer package 20. The curved breakable sections 41*a*, 42*a* are formed so as to face the other long side 51*b* from the bendable section 41*b*. The first sheet body 31 attached to the one edge section 20*a* of the outer package 20 and the first small piece 41 have the following positional relationship. Namely, the first sheet body 31 contains an edge side 70 in parallel with the width direction and intersecting the length direction of the outer package 20. This edge side 70 intersects the bendable section 41*b* of the first small piece 41. The first sheet body 31 covers the top surface of the first small piece 41 and the outer package 20 in order to conceal the first small piece 41 to a position that is approximately 20 percent of the bendable section 41*b* in the length direction and bordering on the edge section 70.

As shown in FIG. 3A and FIG. 4B, on the second small piece 42 formed on the other edge section 20*b* of outer package 20, the straight bendable section 42*b* is placed along a short side 61*b* on the side of the other edge section 20*b* which is the side opposite one short side 61*a* on the side of one edge section 20*a*, and in parallel with the width direction intersecting the long sides 51*a*, 51*b* in parallel in the length direction of the outer package 20. Also, the curved breakable sections 42*a* are formed to face the one short side 61*a* from the bendable section 42*b*. The second sheet body 32 attached to the other edge section 20*b* of the outer package 20 and the second small piece 42 have the following positional relationship. Namely, the second sheet body 32 contains an edge side 70 in parallel with the width direction and intersecting the length direction of the outer package 20. This edge section 70 is in parallel with the bendable section 42*b* of the second small piece 42. With this edge section 70 set as the border, the second sheet body 32 covers the second small piece 42 and the upper surface of the outer package 20 in order to conceal the second small piece 42 to a position that is approximately 20 percent of the breakable section 42*a* in the longitudinal direction.

[3. Ink Cartridge Disassembly, Etc.]

After the ink in the ink cartridge 1 of the present embodiment has been used up, the procedure for disassembling, sorting and disposing the ink cartridge 1 is described as follows.

First of all, the user peels off the first and second sheet bodies 31, 32 of material different from the outer package 20. Next, the user removes the latch section 30 from the outer package 20, and extracts the latch section 30 and ink container 10 from the outer package 20. The user next crushes into a flat shape the now empty outer package 20 where both edge sections 20*a*, 20*b* are released. The sorting into the respective materials and disposal is then performed.

Figure 5A:
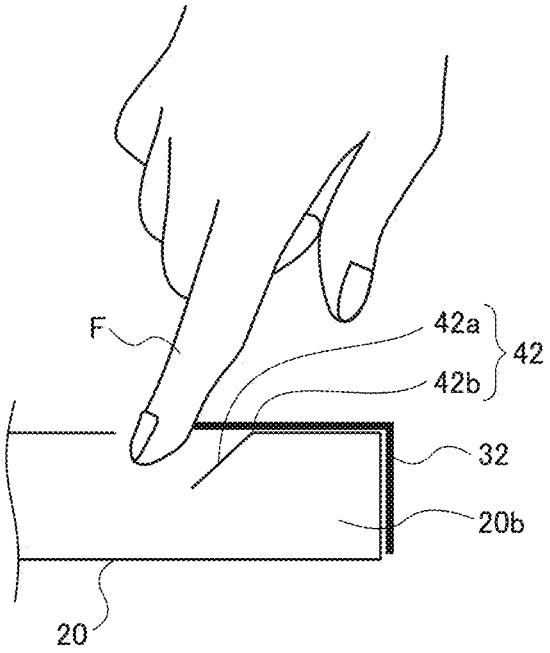
FIGS. 5A and 5B are illustrative views for describing the effect during peeling of the sheet body by utilizing the small piece for the same cartridge.
Figure 5B:
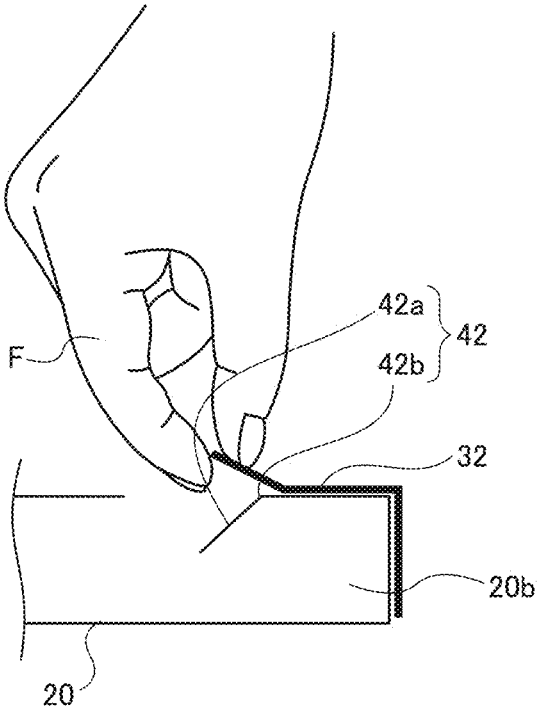
Figure 6:
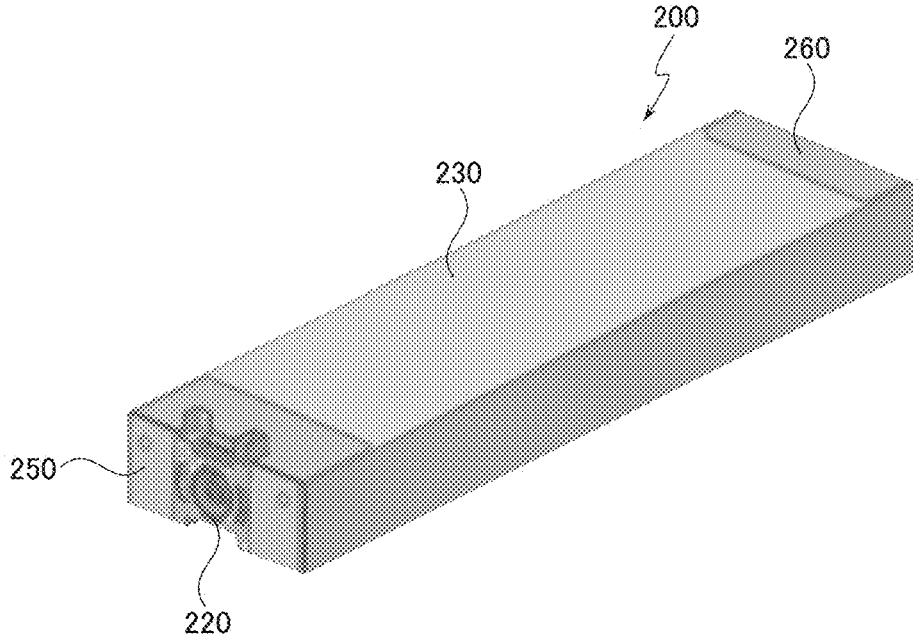
FIG. 6 PRIOR ART
FIG. 6 is schematic perspective view of the ink cartridge of the related art.

In the disassembly process for the above-described ink cartridge 1, when peeling off the first and second sheet bodies 31, 32 from the outer package 20, the user can press the above-described second small piece 42 to inside of the outer package 20 by a finger F as shown in FIG. 5A serving as the example for the second small piece 42; by holding the section of the sheet body 32 peeled from the breakable section 42*a* with the finger F, and peeling the sheet body 32 from the outer package 20 as shown in FIG. 5B, the user can easily carry out the sorting task.

In other words, the small pieces 41, 42 with cuts formed as rough perforations on a portion of the outer package 20 are placed in a state so that at least a portion of the breakable sections 41*a*, 42*a* are continuous between the surface of the outer package 20 covered by the sheet bodies 31, 32 and the surface of the outer package 20 not covered by the sheet bodies 31, 32. Therefore, the user presses the small pieces 41, 42 of outer package 20 inwards by finger, the small pieces 41, 42 are broken at the breakable sections 41*a*, 42*a* and are bent at the bendable sections 41*b*, 42*b* to make them separate from the outer package 20, and sink inwards into the outer package 20. The edge side 70 of the sheet bodies 31, 32 peeled from the small pieces 41, 42 can in this way be set in a suspended upward state, the user grasps the edge side 70 of these sheet bodies 31, 32, and with this as a start point can peel the sheet bodies 31, 32 along the longitudinal direction of the outer package 20.

During this task, the breakable sections 41*a*, 42*a* are configured with intermittent cuts in a curving pattern so that when the user places a fingertip and presses on the breakable section 41*a*, 42*a*, a uniform force can be applied to the overall breakable sections 41*a*, 42*a* along the bulge of the fingertip, and in this way the task of reliably separating the small pieces 41, 42 from the outer package 20 and pressing inwards can be easily accomplished.

As shown in particular in FIG. 3A and FIG. 4A, in the first small piece 41 in contact with the one edge section 20*a* of the outer package 20, the straight bendable section 41*b* is placed along one long side 51*a* in parallel with the longitudinal direction of outer package 20; and the curved breakable section 41*a* is formed so as to face the other long side 51*b* along the width direction of outer package 20 from the bendable section 41*b*. Therefore, when the user performs the task of pressing the first small piece 41 into the inside of the outer package 20, the user's hand pressing the first small piece 41 grasps the longitudinal outer package 20 from the one long side 51*a* side, so that there is no need to touch the edge surface of the one edge section 20*a* where the ink outlet is located. So in the ink cartridge 1 disassembly task after usage, users can peel the sheet body 31 on the side of the one edge section 20*a* with little possibility of touching the ink outlet on the one edge section 20*a* of the outer package 20 with their hands, and therefore the user can perform disassembly tasks without staining their hands.

As shown in FIG. 3A, due to restrictions on the position in which the first small piece 41 is placed in the long side 51*a* side of outer package 20, slightly less than half the overall length of the breakable section 41*a* is covered by the first sheet body 31, however the surface area not covered by the sheet body 31 is set larger than the second small piece 42, so that adequate force can be applied when pressing with a finger and no particular problems will occur with the breakage effect.

As shown in particular in FIG. 3A and FIG. 4B, the second small piece 42 formed in contact with the other end section 20*b* of the outer package 20 on the side opposite the ink outlet is placed along the other short side 61*b* at the other edge section 20*b* side of the outer package 20; and the curved breakable section 42*a* is formed so as to face the one short side 61*a* along the longitudinal direction of outer package 20 from the bendable section 42*b*. Therefore in the disassembly task of the cartridge 1 after usage, when the user peels the second sheet body 32 on the side of the other edge section 20*b*, the user's hand pressing the second small piece 42 is in a state grasping the other edge section 20*b* of the longitudinal outer package 20 from the edge side, and the shape of the user's finger pressing the second small piece 42 into the inside of the outer package 20 matches the curve shape of the breakable section 42*a*, and also the bendable section 42*b* is along the short side 61*b* having especially high strength in the outer package 20 so that the user's finger can in particular apply a highly effective force to the breakable section 42*a*, and the task of pressing the second small piece 42 into the inside of the outer package 20 is even easier.

As shown in FIG. 3A, the second small piece 42 has a smaller surface area than the first small piece 41 but the second sheet body 32 covers the bendable section 42*b* and slightly less than approximately 20 percent of the total length of the breakable section 42*a* so that about the same force as pressing the small piece 41 can be applied with the finger and therefore there are no particular problems with the breakage effect.

The positional relationships of the sheet bodies 31, 32 with the placement of the small pieces 41, 42 as described above are merely one example, and various types of adaptations and variations can be utilized for the extent to which the sheet bodies 31, 32 in what configuration cover what overall surface area of the small pieces 41, 42. An example is shown in FIG. 3A in which the second small pieces 42 may be placed facing opposite on left and right. Namely, the bendable section 42*b* of the second small piece 42 may be shifted more to the left than is specified in the figure, and the curved breakable section 42*a* may be formed so as to face the other short side 61*b* along the longitudinal direction of the outer package 20 from the bendable section 42*b* and a portion of that breakable section 42*a* is covered by the second sheet body 32.

A hole section 21 for drawing outward is formed at the lower surface of the outer package 20 to pass through the surface of the outer package 20 as shown in FIG. 2B and FIG. 3C. This hole section 21 is formed by forming a specified cut at specified forming locations of the outer package 20; and bending the cut section to the inner surface side and also bending towards the end side on the member surface of the outer package 20.

As shown in FIG. 2A, on the other edge section 20*b* side of the outer package 20, a partition member 22 is positioned to attain a shape for an internal space between the end section of the ink container 10 and the inner side of the outer package 20. Along with a side section of the space forming a triangular shape, the space secured by this partition member 22 is a position corresponding to the rear side of the hole section 21 at the inner section of the outer package 20.

Forming a partition member 22 in the outer package 20 and a hole section 21 in the outer surface of the outer package 20 of the ink cartridge 1 in this way allows the user to grasp the hole section 21 of the other edge section 20*b* of the outer package 20 by hand and pull out the ink cartridge 1 when attaching or detaching the ink cartridge 1, and making attaching and detaching the cartridge 1 easier and improving the operability. Moreover, the user's hand does not directly touch the ink container 10 during attaching and detaching of the ink cartridge 1 by grasping the hole section 21 so that damage to the ink container 10 during attaching or detaching such as from the user's personal accessories or fingernails is prevented.

Moreover, the insertion direction relative to the outer package 20 of the ink container 10, the attaching/detaching direction A, and further the ink outflow direction B during ink supplying are positioned along the same axis so that no excessive stress occurs in the outer package 20 and the possibility of damage to the outer package 20 or the attaching/detaching mechanisms such as the ink supply section 13 or the holder section 131 can be reduced.

In the above-described embodiment, the small pieces formed on the outer package are subdivided by breakable sections and bendable sections, and pressing the small piece with a finger breaks the breakable section and bends the bendable section so that the small piece is pressed into the outer package in a state where the small piece is joined to the outer package. However, the small pieces formed on the outer package may be subdivided just by the breakable sections. In this case, pressing the small piece with a finger breaks the breakable section and the entire small piece separates from the outer package, but there is still just a portion of the sheet body suspended in an upward state in the hole of the outer package formed from which the small piece separated, and this gripping location for peeling the sheet body is the same as the embodiment. Thus there is no change in the sheet body peeling effect.

DESCRIPTION OF REFERENCE SIGNS

1 . . . ink cartridge
10 . . . ink container
20 . . . outer package
20*a* . . . edge section (first edge section)
20*b* . . . other end section (the second edge section)
30 . . . latching section
30*a* . . . abutting surface
31 . . . first sheet body
32 . . . second sheet body
41 . . . first small piece
41*a* . . . breakable section
41*b* . . . bendable section
42 . . . second small piece
42*a* . . . breakable section
42*b* . . . bendable section
51*a* . . . one long side of outer package
51*b* . . . other long side of outer package
61*a* . . . one short side
61*b* . . . other short side
70 . . . edge side of sheet body
100 . . . printing device
110 . . . control unit
120 . . . setting operation unit
130 . . . cartridge mounting mechanism
131 . . . holder section
140 . . . upper surface device
200 . . . ink cartridge
A . . . attaching/detaching direction
A1 . . . loading direction
A2 . . . removing direction
B . . . ink outflow direction

The invention claimed is:

1. An ink cartridge attachable to and detachable from a printing device, and comprising:

an outer package;

an ink container housed inside the outer package; and a sheet body attached to an outer surface of the outer package, wherein the outer package includes:

a breakable section that is formed consecutively between a surface of the outer package covered by the sheet body and a surface of the outer package not covered by the sheet body, and is broken by external force; and a small piece that is subdivided by the breakable section and is pressed inside the outer package by breaking the breakable section.

2. The ink cartridge according to claim 1, wherein the small piece is subdivided from the outer package not only by the breakable section but also by a bendable section bent by external force, and is pressed into the inside of the outer package by bending the bendable section along with breaking the breakable section.

3. The ink cartridge according to claim 2, wherein the breakable section contains intermittent cuts formed in a shape including a curve.

4. The ink cartridge according to claim 3, wherein the outer package is a longitudinal box assembled from a single development piece; and the first sheet body and the second sheet body respectively hold a first edge section of the outer package formed with an ink outlet and a second edge section of the outer package on the side opposite to the first edge section in their assembled state.

5. The ink cartridge according to claim 4, wherein the first small piece formed on the first edge section includes the straight bendable section parallel to the longitudinal direction and placed along one long side, and the curved breakable section formed so as to face the other long side from the bendable section.

6. The ink cartridge according to claim 5, wherein the second small piece formed on the second edge section includes the straight bendable section parallel to a width direction and placed along the other short side on a side opposite to the one short side on the outlet side, and the curved breakable section formed so as to face the one short side from the bendable section.

* * * * *